US011072968B1

(12) United States Patent
Downs, Jr. et al.

(10) Patent No.: US 11,072,968 B1
(45) Date of Patent: Jul. 27, 2021

(54) INTEGRATED DOOR FRAMING SYSTEM

(71) Applicants: Donald A. Downs, Jr., Dundee, FL (US); Tammy M. Downs, Dundee, FL (US)

(72) Inventors: Donald A. Downs, Jr., Dundee, FL (US); Tammy M. Downs, Dundee, FL (US)

( * ) Notice: Subject to any disclaimer, the term of this patent is extended or adjusted under 35 U.S.C. 154(b) by 0 days.

(21) Appl. No.: 16/211,614

(22) Filed: Dec. 6, 2018

Related U.S. Application Data

(60) Provisional application No. 62/595,179, filed on Dec. 6, 2017.

(51) Int. Cl.

| | |
|---|---|
| ***E06B 1/04*** | (2006.01) |
| ***E06B 1/30*** | (2006.01) |
| ***E04F 19/02*** | (2006.01) |
| ***E06B 1/60*** | (2006.01) |
| ***E06B 1/52*** | (2006.01) |

(52) U.S. Cl.
CPC ..... *E06B 1/30* (2013.01); *E04F 19/02* (2013.01); *E06B 1/52* (2013.01); *E06B 1/60* (2013.01)

(58) Field of Classification Search
CPC ..... E06B 1/52; E06B 1/56; E06B 1/04; E06B 1/06; E06B 1/08; E06B 1/10; E06B 1/20; E06B 1/26; E06B 3/984; E06B 1/30; E04F 21/0015; E04F 21/0007
USPC ..... 52/287.1, 588.1, 204.71, 457, 204.1, 52/204.2, 211, 212, 215, 217, 456, 288.1, 52/213, 210; 403/295, 292
See application file for complete search history.

(56) References Cited

U.S. PATENT DOCUMENTS

| | | | | | |
|---|---|---|---|---|---|
| 2,736,930 | A * | 3/1956 | Longley | E06B 1/08 | 52/211 |
| 2,742,146 | A * | 4/1956 | Lester, Jr. | B65D 81/057 | 206/325 |
| 3,040,390 | A * | 6/1962 | Carlton | E06B 1/08 | 52/211 |
| 3,111,724 | A * | 11/1963 | Piekarski | E06B 1/10 | 206/325 |
| 3,545,135 | A * | 12/1970 | Lieber | E06B 1/30 | 49/505 |
| 3,800,488 | A * | 4/1974 | Swanson | E06B 3/9685 | 52/212 |
| 3,943,679 | A * | 3/1976 | Dissinger | E06B 3/5892 | 52/473 |
| 4,166,346 | A * | 9/1979 | Barr | E06B 1/08 | 49/504 |
| 4,539,784 | A * | 9/1985 | Allen | E04F 21/0015 | 52/126.1 |
| 5,203,130 | A * | 4/1993 | Freelove | E06B 1/30 | 52/211 |
| 5,365,708 | A * | 11/1994 | Winston | E06B 1/10 | 49/504 |
| 5,974,745 | A * | 11/1999 | Barr | E06B 1/10 | 49/504 |

(Continued)

*Primary Examiner* — Chi Q Nguyen
(74) *Attorney, Agent, or Firm* — John Rizvi; John Rizvi, P.A.—The Patent Professor®

(57) ABSTRACT

An integrated door framing system is provided including a first L-shaped piece and a second L-shaped piece which can be assembled to form a U-shaped body that fits over a wall edge facing a wall opening formed for installing a door or window therewithin. The U-shaped body provides a complete, integrated door frame, casing, and molding assembly using a reduced and easy-to-assemble set of parts.

17 Claims, 8 Drawing Sheets

(56) References Cited

U.S. PATENT DOCUMENTS

| | | | | |
|---|---|---|---|---|
| 5,979,129 | A * | 11/1999 | Azar | E04F 21/0015 52/211 |
| 6,192,638 | B1 * | 2/2001 | Wang | E06B 1/10 49/504 |
| 6,581,337 | B1 * | 6/2003 | Skov | E04B 1/34315 52/79.5 |
| 6,699,327 | B2 * | 3/2004 | VanRossen | B05B 12/20 118/505 |
| 7,624,548 | B2 * | 12/2009 | Hansen | E04G 21/24 52/202 |
| 8,484,913 | B2 * | 7/2013 | Charbonneau | E06B 1/08 52/210 |
| 9,010,066 | B1 * | 4/2015 | Sand | E04F 21/0015 52/745.21 |
| 2009/0013636 | A1 * | 1/2009 | Wilson | E06B 1/10 52/718.01 |
| 2009/0188181 | A1 * | 7/2009 | Forbis | E04B 1/80 52/173.1 |
| 2009/0229203 | A1 * | 9/2009 | McLaughlin, Jr. | E04C 2/521 52/220.7 |
| 2010/0011699 | A1 * | 1/2010 | Weimer | E04B 2/7401 52/745.1 |
| 2011/0047912 | A1 * | 3/2011 | Armijo | E04B 1/12 52/309.4 |
| 2012/0031021 | A1 * | 2/2012 | Charbonneau | E06B 1/08 52/204.1 |
| 2013/0042556 | A1 * | 2/2013 | Armijo | E04B 1/14 52/309.4 |
| 2014/0053480 | A1 * | 2/2014 | Silk | E06B 1/20 52/217 |
| 2017/0306687 | A1 * | 10/2017 | Lamothe | E06B 3/4618 |
| 2017/0314320 | A1 * | 11/2017 | Giuliani | E06B 1/52 |

* cited by examiner

INTEGRATED DOOR FRAMING SYSTEM

CROSS-REFERENCE TO RELATED APPLICATION

This application claims the benefit of U.S. Provisional Patent Application Ser. No. 62/595,179, filed on Dec. 6, 2017, which is incorporated herein in its entirety.

FIELD OF THE INVENTION

The present invention relates generally to door framing systems, and more particularly, to an integrated door framing system comprising two L-shaped pieces assembled together and configured to provide a completed integrated door framing system.

BACKGROUND OF THE INVENTION

Doors are generally framed by a door framing and molding assembly placed in a doorway. The door being framed may be located in an interior doorway, such as a doorway between bedrooms or a doorway to a bathroom. The door being framed may also be an exterior door, such as in a front door, back door, or a patio door. These doors may be found in commercial and residential structures.

Typically, a door framing and molding assembly may include ornate detail or patterns which are hand carved or molded. These decorative framing and molding assemblies may also include a contoured top surface to form raised decorative portions. These assemblies may also include other intricacies and finishes which provide for aesthetic appeal. Because of the addition of these supplementary decorations, these assemblies require more than a multiple number of structural and decorative pieces for the door framing and molding assemblies to function as an integral whole.

It is common construction practice to use extensive amount of trim molding in conjunction with door framing and molding assemblies. Trim molding is a general term used to describe all types of molding used to provide for an ornamental outline. Trim molding used to trim the perimeter of a door or window is referred to as a casing. Most casings are usually elongated thin flat pieces with linear side edges. Decorative profiles are often cut into the linear side edges of the casings. Cutting decorative profiles into the linear side edges is known as milling. Casing pieces with aesthetically pleasing milled decorative profiles increase the complexity of the door framing and molding assemblies, because of the labor required to perform the milling. The additional milling of the casings necessitates an increase in cost and in the potential number of structural and decorative pieces needed to form a completed door frame assembly.

The construction industry, in responding to the market demands for further sophistication in home designs, has developed complex and intricate door framing systems. These door framing systems are more expensive than traditional door framing systems because of the additional structural and ornamental detail. Another factor contributing to the increased complexity of door framing systems is the variability of front door designs. Architects, when designing homes for distinction, focus on the front door as a signature mark for the home. Quite often, the uniqueness of the front door necessitates a complex door framing system to conform to variations in wall depth, the number of door perimeter sides, and door perimeter contours which are non-traditional but inherent in the front door design.

Existing door framing systems typically include several separate structural pieces. These separate pieces include pieces such as the door frame, a casing trim for one side of the door, a casing trim for the other side of the door, additional telescopic bridging planks for doors with thicker walls, molding trim for one side of the door frame, and molding trim for the other side of the door frame. Further, as more decorative details are added to a door framing design, additional decorative elements may be needed.

Because of the incorporation of different structural and decorative elements within current door framing systems, these door framing systems require more than a multiple number of separate structural and decorative pieces to construct a door frame. Further, current door framing systems costs increase with an increase in the complexity of decorative intricacies. Additionally, current door framing systems costs increase as the number of sides of the door perimeter increases. Traditional door perimeters have four sides. However, many current door designs incorporate doors with additional perimeter sides, for example, hexagonal or octagonal shapes. Also, current door framing system costs increase as the complexity of the contour of the door perimeter changes. For example, when a contour of the door perimeter includes an arch. Further still, as the structural complexity and decorative elements are increased, the number of pieces required to form a completed integrated door frame increase.

Accordingly, there is an established need for a door framing system which solves at least one of the aforementioned problems. For example, there is an established need for an integrated door framing system which can provide a door frame and molding without requiring a multiple number of separate pieces.

SUMMARY OF THE INVENTION

The present invention is directed to integrated door framing systems, which can be utilized in commercial and residential structures. The integrated door framing system provides for a door frame for doors of varying complexities with less cost and with fewer pieces than conventional systems. Further, the integrated door framing system in accordance with the present disclosure is scalable and can be used in residential, commercial, and/or institutional structures of all sizes.

In a first implementation of the invention, an integrated door framing system comprises an elongated, first L-shaped piece and an elongated, second. L-shaped piece. The first and second L-shaped pieces assemble to form a U-shaped body configured to fit on an area of a wall facing a wall opening and having a door-frame surface delimiting wall opening. The U-shaped body formed by the assembled first and second L-shaped pieces fits over an outer first surface, an opposed, inner second surface and the door-frame surface of the wall.

In a second aspect, the first and second L-shaped pieces can include a male portion and a female, socket portion, respectively. The male portion and female, socket portion are configured to connect with one another to interlock the first and second L-shaped pieces to one another.

In another aspect, an outer, end surface of the male portion can be configured to rest on an inner, end surface of a socket gap of the female, socket portion when the first and second L-shaped pieces are assembled to form the U-shaped body.

In another aspect, an inner wall of the U-shaped body can include a protruding strip extending along the integrated door framing system, the protruding strip providing at least one side surface for the resting thereon of a door arranged in the wall opening.

In another aspect, each one of the first and second L-shaped pieces can include a first body portion and a second body portion arranged in an L-shaped configuration relative to one another. The first body portion comprises an inner surface configured to face the door-frame surface of the wall and an outer surface configured to face outward of the wall. In turn, the second body portion comprises an inner surface configured to face the wall and an outer surface configured to face outward of the wall.

In yet another aspect, the inner surface of the first body portion and the inner surface of the second body portion may form an angle of 90 degrees relative to one another.

In another aspect, the inner surface of the first body portion and the inner surface of the second body portion may form an angle less than 90 degrees relative to one another.

In another aspect, at least one of the first and second L-shaped pieces can be deformable, such that the angle formed by inner surface of the first body portion and the inner surface of the second body portion is adjustable.

In another aspect, the outer surface of the second body portion can include at least one decorative element or molding intricacy.

In yet another aspect, the first body portion of the first U-shaped piece can include a male portion and the first body portion of the second L-shaped piece can include a female, socket portion. The male portion and female, socket portion can be configured to couple with one another to interlock the first and second L-shaped pieces to one another.

In another aspect, an inner wall of the socket portion can provide a protruding strip extending along the integrated door framing system, the protruding strip featuring at least one side surface for the resting thereon of a door arranged in the wall opening.

In another aspect, the protruding strip can provide two opposite side surfaces for the resting thereon of a door arranged in the wall opening.

In yet another aspect, the first body portion of the first L-shaped piece and the first body portion of the second L-shaped piece can include respective transverse, end seating surfaces configured to rest on one another when the first and second L-shaped pieces are assembled to form the U-shaped body.

In another aspect, at least one of the first L-shaped piece and second L-shaped piece can be formed by polyvinyl chloride (PVC) foam extrusion.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1-8. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an integrated door framing system which can include two pieces such that when they are connected they form an integrated door frame and molding.

Figure 1:
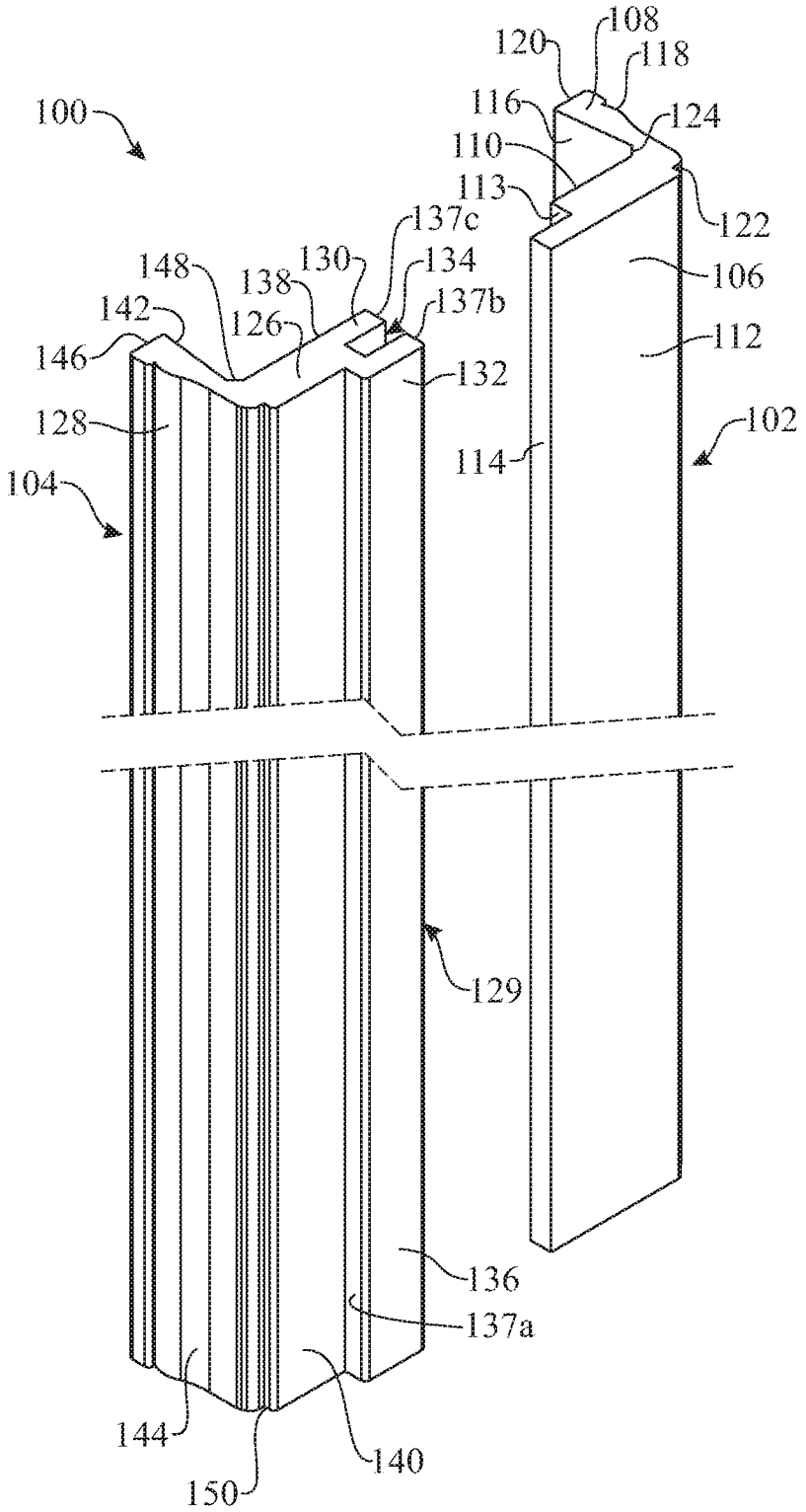
FIG. 1 presents a top front exploded isometric view showing a first L-shaped piece and a second. L-shaped piece of an integrated door framing system in accordance with an illustrative embodiment of the present invention.
Figure 2:
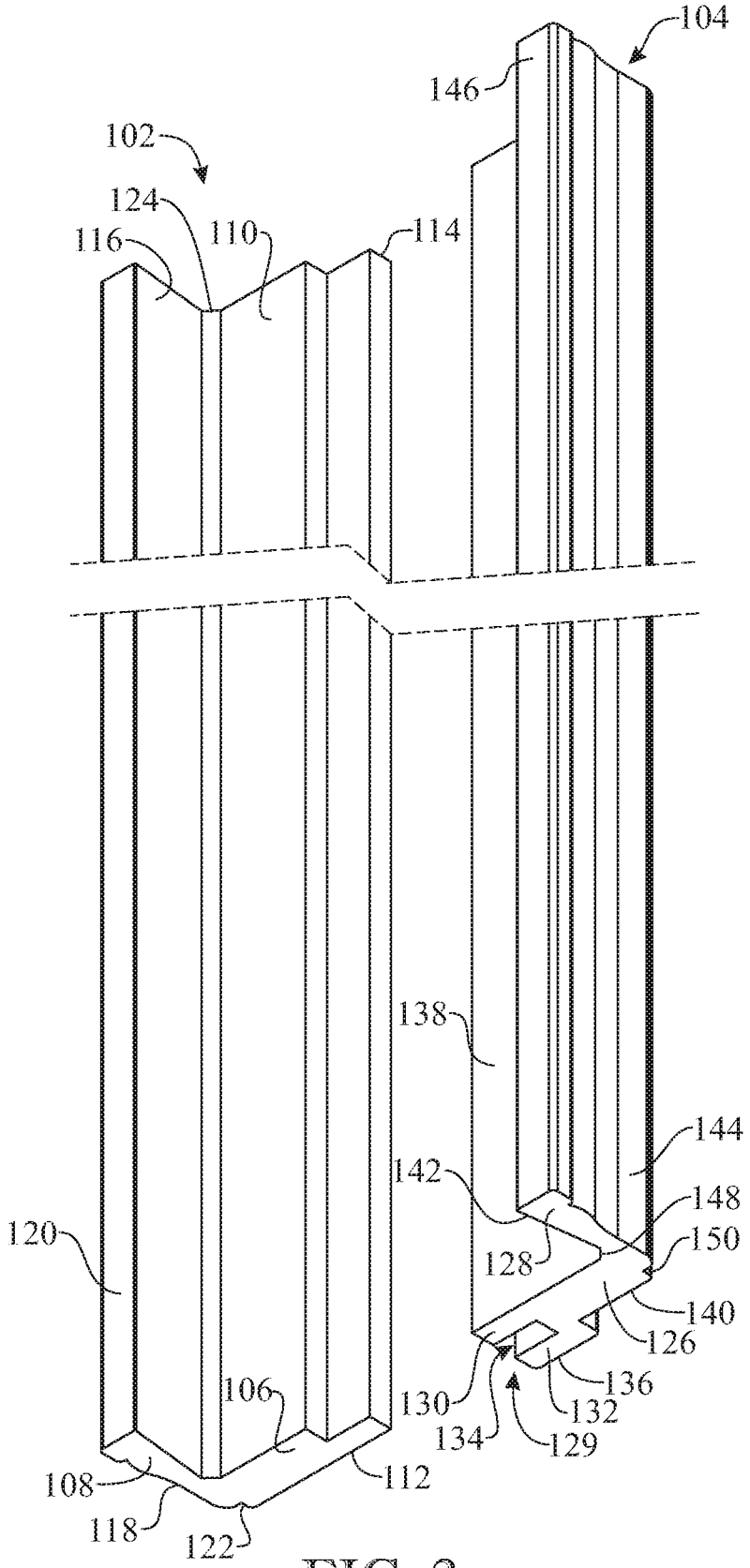
FIG. 2 presents a bottom rear exploded isometric view showing the integrated door framing system of FIG. 1.

Referring initially to FIGS. 1 and 2, an integrated door framing system 100 is illustrated in accordance with a first embodiment of the present invention. The integrated door framing system 100 can include a first L-shaped piece 102 and a second L-shaped piece 104. In some embodiments, the first L-shaped piece 102 and/or second L-shaped piece 104 can be formed by polyvinyl chloride (PVC) foam extrusion and can be resistant to water absorption, ultraviolet (UV) rays and organic decomposition.

The first L-shaped piece 102 can include a frame or first body portion 106 and a molding or second body portion 108 arranged at an angle with one another forming an L-shape or first L-shaped piece 102. The first body portion 106 can include an inside surface 110 and an outside surface 112. A transverse seating surface 113 can extend from an outer end of the inside surface 110. The first body portion 106 can include a male end portion 114 on an outer end and an inner end connecting to the second body portion 108. The second body portion 108 can include an inside surface 116 and an outside surface 118. The inside surfaces 110 and 116 can be arranged forming an angle equal to 90 degrees with one another, to rest flatly against perpendicular outer surfaces of a wall. In other embodiments, such as in the present embodiment, the inside surfaces 110 and 116 can be arranged forming an angle less than 90 degrees for purposes that will be hereinafter described. The second body portion 108 can include a foot 120 on an outer end, and an inner end connecting to the first body portion 106. The second body portion 108 and the first body portion 106 are joined at a corner or connecting portion of the first L-shaped piece 102 where an outside corner 122 and an inside corner 124 are formed.

As shown in FIG. 1, the second L-shaped piece 104 can include a frame or first body portion 126 and a molding or second body portion 128 arranged at an angle with one another forming an L-shape or second L-shaped piece 104. The first body portion 126 can include a female end portion 129 comprising an inside socket wall 130, an outside socket wall 132, and a socket gap 134 on an outer end of the first body portion 126. The first body portion 126 can further include an inner end connecting to the second body portion 128. The socket gap 134 is interposed between the inside socket wall 130 and the outside socket wall 132. The outside socket wall 132 includes an outside surface 136 on an opposite side of the socket gap 134. The first body portion 126 can include an inside surface 138 and an outside surface 140. The second body portion 128 can include an inside surface 142 and an outer surface 144. The inside surfaces 138 and 142 can be arranged forming an angle equal to 90 degrees with one another, to rest flatly against perpendicular outer surfaces of a wall, in other embodiments, such as in the present embodiment, the inside surfaces 138 and 142 can be arranged forming an angle less than 90 degrees for purposes that will be hereinafter described. The second body portion 128 can include a foot 146 on an outer end, and an inner end connecting to the first body portion 126. The first body portion 126 and the second body portion 128 are joined at a corner or connecting portion of the second L-shaped piece 104 where an inside corner 148 and an outside corner 150 are formed.

The female end portion 129 of the second L-shaped piece 104 can further include a first seating surface 137*a* extending preferably from the outside surface 136 of the outside socket wall 132 to the outside surface 140 of the adjacent reminder of the first body portion 126. On the outer end of the female end portion 129, in turn, a second seating surface 137*h* and a third seating surface 137*c* are provided on opposite sides of the socket gap 134. The first and second seating surfaces 137*a* and 137*b* can be perpendicular to the inside surfaces 110 and 138, such that either one of the first and second seating surfaces 137*a* and 137*b* allows for the resting thereon of a door 300 (FIG. T when the door 300 is in a closed position. In turn, the third seating surface 137*c* can be configured to contact the seating surface 113 of the first body portion 106 as will be described in greater detail hereinafter.

Figure 6:
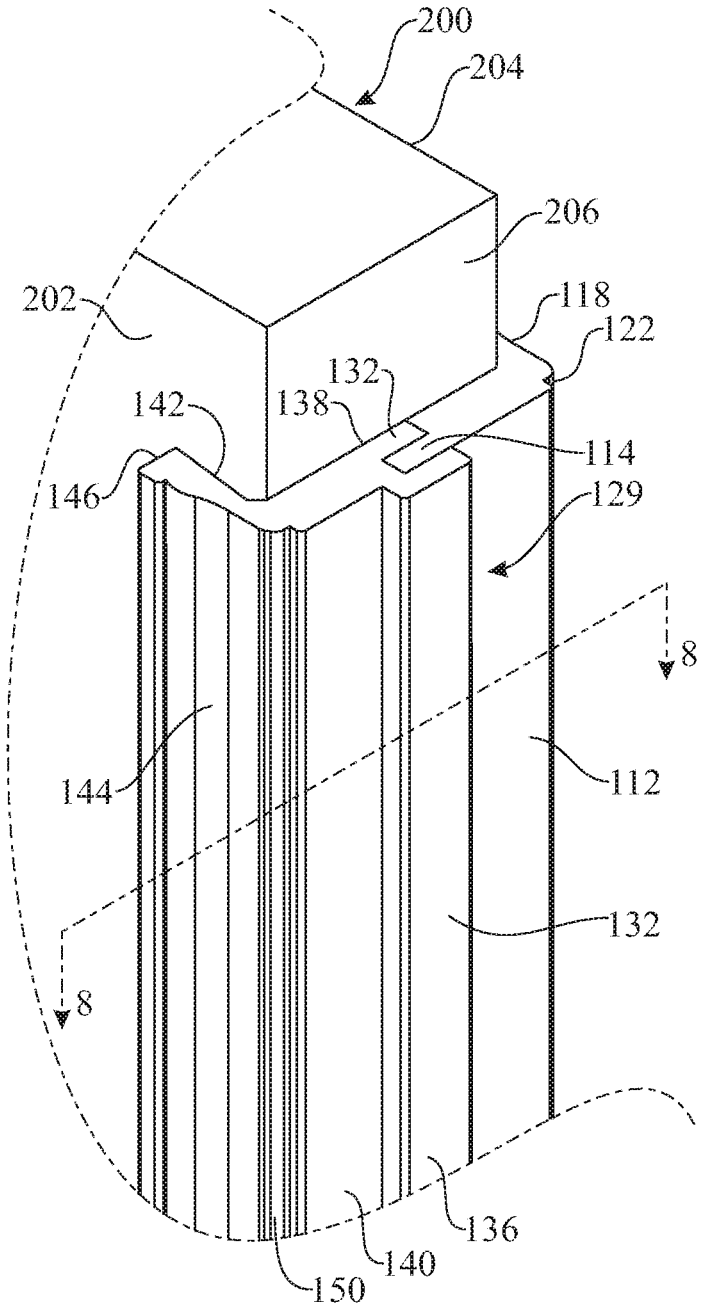
FIG. 6 presents a top front isometric view illustrating a fourth step of installing the integrated door framing system, showing the second L-shaped piece connected to the first L-shaped piece.

As best shown in FIG. 6, the integrated door framing system 100 may be assembled on a wall 200. The wall 200 may include an outer, first surface 202, an opposed inner, second surface 204, and a door-frame surface 206 extending transversely between the outer, first surface 202 and the inner, second surface 204 of the wall 200.

Figure 3:
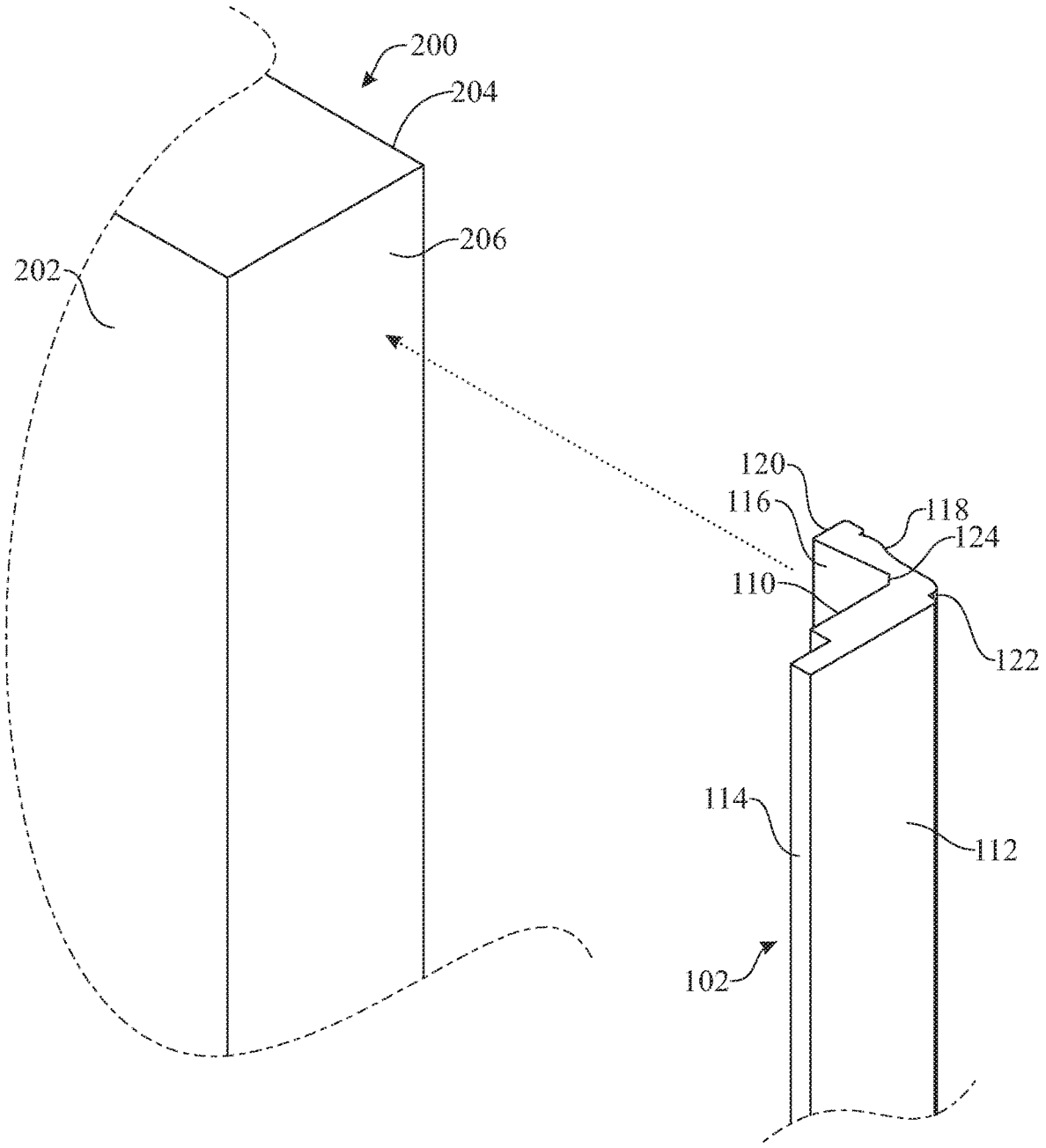
FIG. 3 presents a top front isometric view illustrating a first step of installing the integrated door framing system, showing the first L-shaped piece being assembled to a wall.

The illustrations of FIGS. 3-6 show a sequence of steps for attaching the integrated door framing system 100 onto the wall 200. Initially, as shown in FIG. 3, the first L-shaped piece 102 can be aligned with the wall 200.

Figure 4:
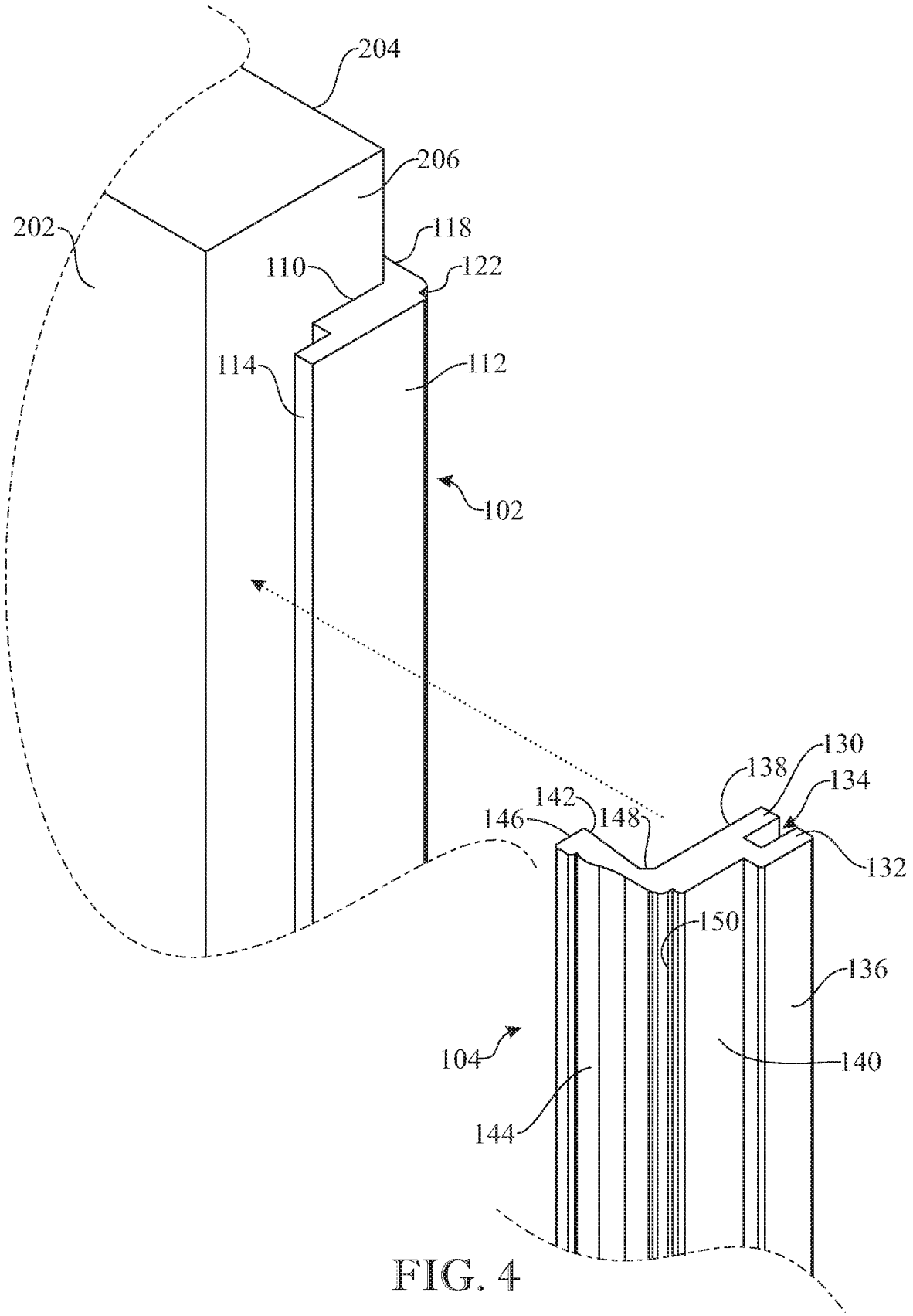
FIG. 4 presents a top front isometric view illustrating a second step of installing the integrated door framing system, showing the first L-shaped piece assembled onto the wall and a second L-shaped piece being placed against the wall.

Next, as illustrated in FIG. 4, the inside surface 110 of the first body portion 106 and the inside surface 116 of the second body portion 108 of the first L-shaped piece 102 are placed against or joined to the door-frame surface 206 and to the inner, second surface 204, respectively, of the wall 200. The first L-shaped piece 102 can be attached to the wall 200 with, but not limited to, adhesive, nails, fused connection, screws, dovetailing, and/or interlocking pieces. Once the first L-shaped piece 102 has been attached to the wall 200, the second. L-shaped piece 104 can be aligned with the wall 200.

Figure 5:
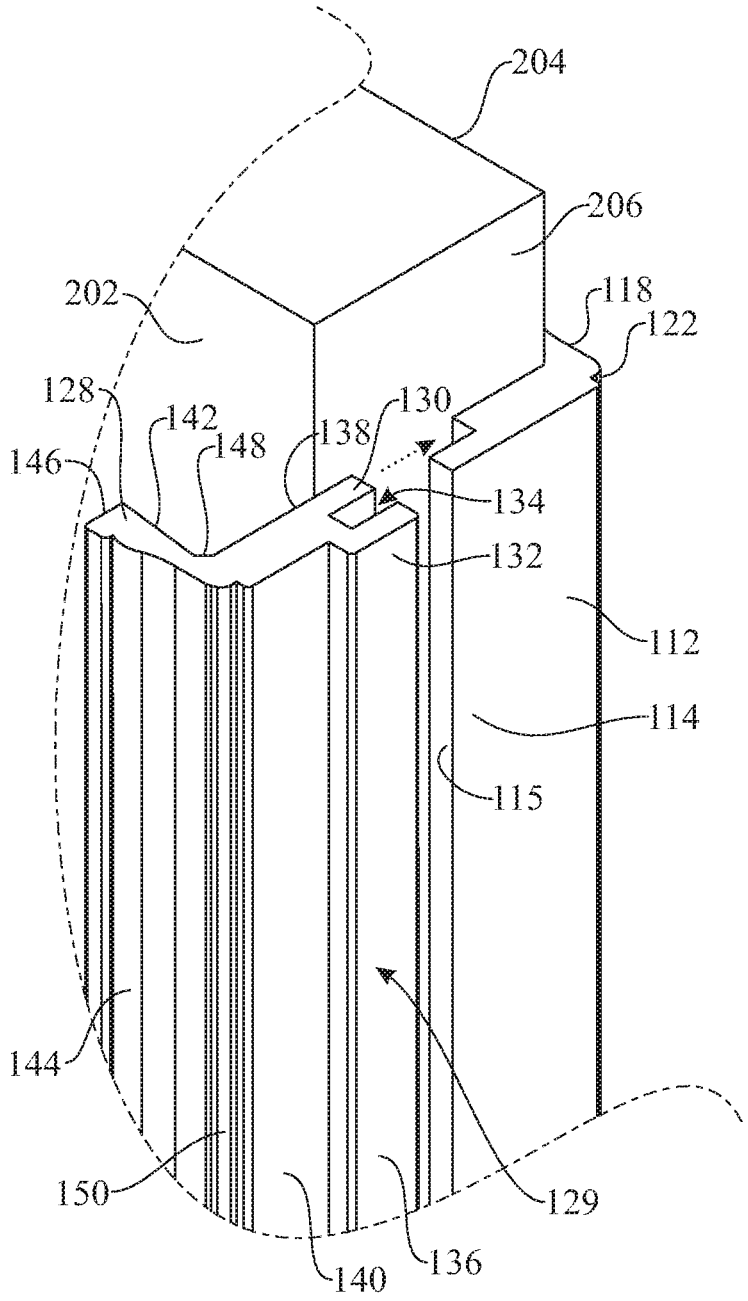
FIG. 5 presents a top isometric view illustrating a third step of installing the integrated door framing system, showing the second L-shaped piece being connected to the first L-shaped piece.

As best shown in FIG. 5, the second L-shaped piece 104 is then moved towards the wall and aligned to connect to the first L-shaped piece 102. The first L-shaped piece 102 can already be attached to the wall 200. The male end portion 114 of the first L-shaped piece 102 is aligned with the socket gap 134 of the female end portion 129 of the second L-shaped piece 104 in preparation for connecting the first L-shaped piece 102 to the second L-shaped piece 104.

Turning to FIG. 6, the second L-shaped piece 104 can be moved towards the first L-shaped piece 102 until the female end portion 129 of the second L-shaped piece 104 fits onto the male end portion 114 of the first L-shaped piece 102, with the male end portion 114 of the first L-shaped piece 102 inserted into the socket gap 134 of the second L-shaped piece 104 and interposed between the inside socket wall 130 and the outside socket wall 132 of the second L-shaped piece 104. The second L-shaped piece 104 can then be attached to the wall 200. More specifically, the inside surface 138 of the first body portion 126 and the inside surface 142 of the second body portion 128 of the second L-shaped piece 104 can be joined to the door-frame surface 206 and to the outer, first surface 202, respectively, of the wall 200. The second IL-shaped piece 104 can be attached to the wall 200 with, but not limited to, adhesive, nails, fused connection, screws, dovetailing, and/or interlocking pieces. In some applications, in addition to the aforementioned male-female fitting of the first and second L-shaped pieces 102 and 104, the first and second L, shaped pieces 102 and 104 can be joined to one another with, but not limited to, adhesive, nails, fused connection, screws, dovetailing, male and female connections, pins, and/or interlocking pieces.

Figure 8:
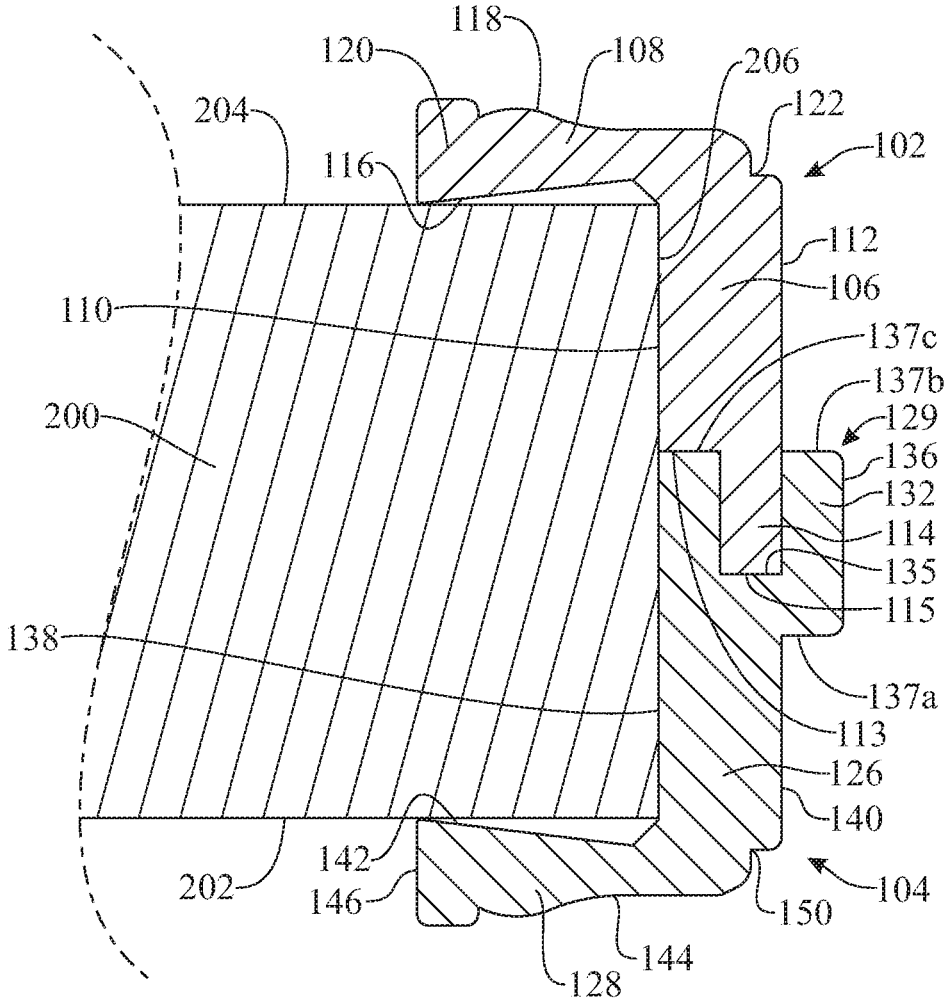
FIG. 8 presents a cross-sectional top plan view showing the integrated door framing system on the wall, the cross section taken along section 8-8 indicated in FIG. 6, wherein the first L-shaped piece is connected to the second L-shaped piece.

As seen in a cross-sectional view in FIG. 8, when assembled to one another, the first L-shaped piece 102 and the second L-shaped piece 104 form a U-shaped body which embraces the outer, first surface 202, the inner, second surface 204 and the door-frame surface 206 of the wall 200, similarly to a conventional door frame and molding assembly. However, unlike conventional door frame and molding assemblies, the present invention requires two parts only (the first and second U-shaped pieces 102 and 104) and can be assembled following a simple sequence as described heretofore. In the assembled position of FIG. 8, the seating surface 113 of the first L-shaped piece 102 and the third seating surface 137*c* of the second L-shaped piece 104 can rest against one another while an outer surface 115 of the male end portion 114 can rest against an inner end or surface 135 of the socket gap 134, providing a robust attachment. In turn, the outside socket wall 132 constitutes a strip or batten which protrudes from the outside surfaces 112 and 140, such that the first and second seating surfaces 137*a* and 137*b* of the outside socket wall 132 provide frontward- and rearward-facing seating surfaces on which a closed door 300 can rest.

Furthermore, as shown in FIG. 8 and mentioned heretofore, the inside surfaces 110 and 116 of the first and second body portions 106 and 108 of the first L-shaped piece 102 form an angle less than 90 degrees relative to one another. Similarly, the inside surfaces 138 and 142 of the first and second body portions 126 and 128 of the second L-shaped piece 104 form an angle less than 90 degrees relative to one another. This allows the U-shaped body formed by the assembled first and second L-shaped pieces 102 and 104 to adjust to walls 200 having varying thicknesses, provided that the first and second L-shaped pieces 102 and 104 are manufactured with a sufficient flexibility to allow the first and second. L-shaped pieces 102 and 104 to deform, and more specifically, to enable the angle formed between the corresponding first and second body portions to vary. In different embodiments of the invention, the first and/or second L shaped pieces 102 and 104 may be elastically or plastically deformable to vary said angle.

Figure 7:
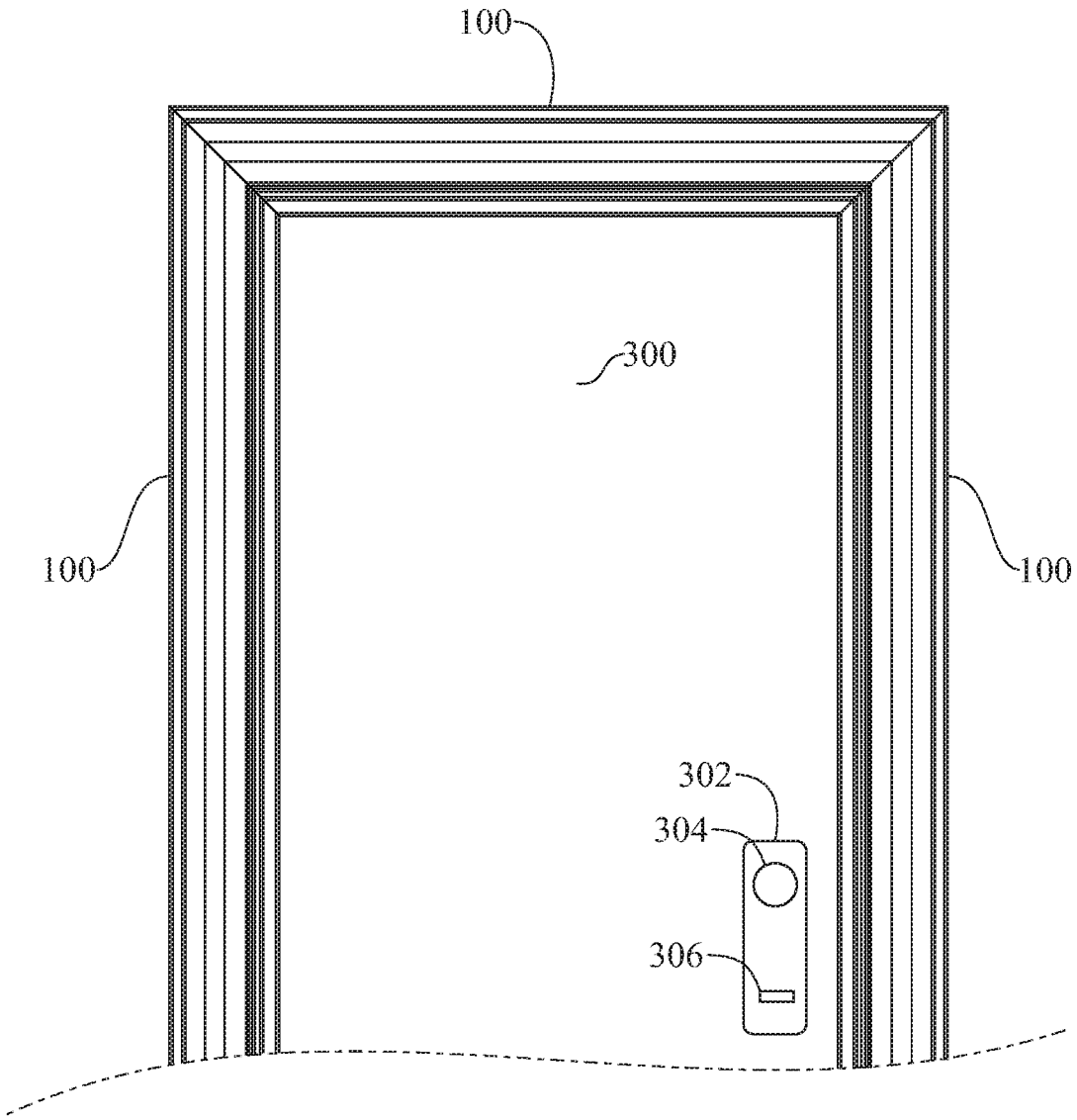
FIG. 7 presents a front elevation view of an installed integrated door framing system and a door.

With reference to FIG. 7, a plurality of integrated door framing systems 100 are attached on more than one sections of a wall 200 on multiple sides of a perimeter of a door 300. The door 300 may include a door handle set 302. The door handle set 302 may include a door handle 304 and a door lock 306. Installation of the integrated door framing system 100 is scalable and can advantageously be assembled on a plurality of perimeter sides and/or shapes. Conventional door framing systems require a plurality of pieces and considerable labor to install. In accordance with the present disclosure, only the first L-shaped piece 102 and the second L-shaped piece 104 are required to assemble the completed integrated door framing system 100 onto a perimeter wall of the door 300. Embodiments of the present invention are cost effective and require less time to install, and provide the advantage of scalability.

In some embodiments, not shown, one or more decorative elements with raised contours, of various dimensions, can be included in the second body portion 108 of the first L-shaped piece 102 and/or the second body portion 128 of the second L-shaped piece 104. Thus, a further advantage of the present invention is that one or more intricate and detailed ornamental designs may be included and be integral to the second body portion 108 of the first L-shaped piece 102 and/or to the second body portion 128 of the second L-shaped piece 104. Thus, other than the first L-shaped piece 102 and the second L-shaped piece 104, no additional pieces are required to provide a completed integrated door framing system 100 which can replace a conventional door framing and molding including a door frame, a casing, and a molding, regardless of the desired ornamental or structural detail of the door framing.

Further embodiments are contemplated without departing from the scope of the present disclosure. For instance, in some embodiments, the integrated door framing system can further include pieces having multiple male end portion and multiple socket components. Alternatively or additionally, the first and second L-shaped pieces can be configured to conform to non-perpendicular wall shapes. Alternatively or additionally, the integrated door framing system can include pieces with a plurality of male and female connectors.

In summary, an integrated door framing system is provided including a first L-shaped piece and a second L-shaped piece which can be assembled to form a U-shaped body that fits over a wall edge facing a wall opening formed for installing a door or window therewithin. The U-shaped body provides a complete, integrated door frame, casing, and molding assembly using a reduced and easy-to-assemble set of parts. More specifically, the integrated door framing system may require no more than two pieces to provide a completed integrated door frame, casing, and molding assembly.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An integrated door framing system to facilitate hanging a door in a doorway opening formed through a wall of a structure, the system installed onto one of a side or a top of the doorway opening wherein the wall includes oppositely disposed wall surfaces and a door-frame surface extending transversely therebetween, said system comprising:

a first elongated L-shaped piece;

a second elongated L-shaped piece;

each of said first and second elongated L-shaped pieces comprising a linear configuration between oppositely disposed ends thereof;

said first and second elongated L-shaped pieces are cooperatively structured to form a U-shaped body dimensioned and configured to fit over and along one of the sides or the top of the doorway opening formed through the wall and extend over a portion of each of the oppositely disposed wall surfaces and the door-frame surface of the wall extending transversely therebetween, wherein each one of said first and second elongated L-shaped pieces comprises a first body portion and a second body portion arranged in an L-shaped configuration relative to one another, wherein said first body portion comprises a substantially planar inner surface configured to abut along and against the door-frame surface of the wall and an outer surface configured to face outward of the door-frame surface of the wall adjacent a portion of the door, and said second body portion comprises a substantially planar inner surface configured to face the portion of a corresponding one of the oppositely disposed wall surfaces of the wall and an outer surface configured to face outward of the portion of the corresponding one of the oppositely disposed wall surfaces of the wall, wherein said substantially planar inner surface of said first body portion and said substantially planar inner surface of said second body portion of at least one of said first elongated L-shaped piece or said second elongated L-shaped piece are interconnected to one another and form an angle less than 90 degrees relative to one another about an inside corner disposed therebetween.

2. The integrated door framing system of claim 1, wherein said first and second elongated L-shaped pieces comprise a male portion and a female socket portion, respectively, configured to connect with one another to interlock said first and second elongated L-shaped pieces to one another.

3. The integrated door framing system of claim 2, wherein an outer, end surface of said male portion is configured to rest on an inner, end surface of a socket gap of said, female socket portion when said first and second elongated L-shaped pieces are assembled to form said U-shaped body.

4. The integrated door framing system of claim 1, wherein an inner wall of the U-shaped body comprises a protruding strip extending along said integrated door framing system, said protruding strip providing at least one side surface for a portion of the door hung in the doorway opening to abut up against.

5. The integrated door framing system of claim 1, wherein at least one of said first and second elongated L-shaped pieces is deformable, such that said angle formed by said substantially planar inner surface of said first body portion and said substantially planar inner surface of said second body portion is adjustable.

6. The integrated door framing system of claim 1, wherein said outer surface of said second body portion comprises at least one decorative element or molding intricacy.

7. The integrated door framing system of claim 1, wherein said first body portion of said first elongated L-shaped piece comprises a male portion and said first body portion of said second elongated L-shaped piece comprises a female socket portion, wherein said male portion and said female socket portion are configured to couple with one another to interlock said first and second elongated L-shaped pieces to one another.

8. The integrated door framing system of claim 7, wherein an inner wall of said female socket portion provides a protruding strip extending along said integrated door framing system, said protruding strip providing at least one side surface for a portion of the door hung in the doorway opening to abut up against.

9. The integrated door framing system of claim 8, wherein said protruding strip provides two opposite side surfaces for the portion of the door to abut up against.

10. The integrated door framing system of claim 1, wherein said first body portion of said first elongated L-shaped piece and said first body portion of said second elongated L-shaped piece comprise respective transverse, end seating surfaces configured to rest on one another when said first and second elongated L-shaped pieces are assembled to form said U-shaped body.

11. The integrated door framing system of claim 1, wherein at least one of said first elongated L-shaped piece and said second elongated U-shaped piece is formed by polyvinyl chloride (PVC) foam extrusion.

12. An integrated door framing system to facilitate hanging a door in a doorway opening formed through a wall of a structure, the system installed onto one of a side or a top of the doorway opening wherein the wall includes oppositely disposed wall surfaces and a door-frame surface extending transversely therebetween, said system comprising:

a first elongated U-shaped piece;

a second elongated L-shaped piece;

each one of said first and second elongated L-shaped pieces comprises a linear configuration between oppositely disposed ends thereof, each one of said first and second elongated U-shaped pieces comprises a first body portion and a second body portion arranged in an L-shaped configuration relative to one another, wherein said first body portion comprises a substantially planar inner surface and an outer surface, and said second body portion comprises a substantially planar inner surface and an outer surface; wherein said substantially planar inner surface of said first body portion and said substantially planar inner surface of said second body portion of at least one of said first elongated L-shaped piece or said second elongated L-shaped piece form an angle of less than 90 degrees relative to one another about an inside corner disposed therebetween, and at least one of said first and second elongated L-shaped pieces is deformable, such that said angle formed by said substantially planar inner surface of said first body portion and said substantially planar inner surface of said second body portion is adjustable, said first and second elongated L-shaped pieces are cooperatively structured to form a U-shaped body configured to adopt a mounted position over one of the sides or the top of the doorway opening formed through the wall in which:

said U-shaped body is dimensioned and configured to fit over and along one of the sides or the top of the doorway opening formed through the wall and extend over a portion of each of the oppositely disposed wall surfaces and the door-frame surface of the wall extending transversely therebetween, and said substantially planar inner surface of said first body portion of each of said first and second elongated L-shaped pieces abuts along and against the door-frame surface of the wall and said outer surface of said first body portion of each of said first and second elongated L-shaped pieces faces outward of the door-frame surface of the wall adjacent a portion of the door, and said substantially planar inner surface of said second body portion of each of said first and second elongated L-shaped pieces faces a portion of a corresponding one of the oppositely disposed wall surfaces of the wall and said outer surface of said second body portion of each of said first and second elongated L-shaped pieces faces outward of the portion of the corresponding one of the oppositely disposed wall surfaces of the wall.

13. The integrated door framing system of claim 12, wherein said outer surface of said second body portion comprises at least one decorative element or molding intricacy.

14. The integrated door framing system of claim 12, wherein said first body portion of said first elongated L-shaped piece comprises a male portion and said first body portion of said second elongated U-shaped piece comprises a female socket portion, wherein said male portion and said female socket portion are configured to couple with one another to interlock said first and second elongated L-shaped pieces to one another.

15. The integrated door framing system of claim 14, wherein an inner wall of said U-shaped body comprises a protruding strip extending along said integrated door framing system, said protruding strip provides two opposite side surfaces for a portion of the door hung in the opening to abut up against.

16. The integrated door framing system of claim 12, wherein said first body portion of said first elongated L-shaped piece and said first body portion of said second elongated L-shaped piece comprise respective transverse, end seating surfaces configured to rest on one another when said first and second L-shaped pieces are assembled to form said U-shaped body.

17. An integrated door framing system to facilitate hanging a door in a doorway opening formed through a wall of a structure, the system being installed onto one of a side or a top of the doorway opening wherein the wall includes oppositely disposed wall surfaces and a door-frame surface extending transversely therebetween, said system comprising:

a first elongated L-shaped piece;

a second elongated L-shaped piece;

each one of said first and second elongated L-shaped pieces comprises a linear configuration between oppositely disposed ends thereof;

each one of said first and second elongated L-shaped pieces comprises a first body portion and a second body portion arranged in an L-shaped configuration relative to one another, wherein said first body portion comprises a substantially planar inner surface and an outer surface, and said second body portion comprises a substantially planar inner surface and an outer surface; wherein said substantially planar inner surface of said first body portion and said substantially planar, inner surface of said second body portion of each of said first elongated L-shaped piece and said second elongated L-shaped piece form an angle of less than 90 degrees relative to one another about an inside corner disposed therebetween, and at least one of said first and second elongated L-shaped pieces is deformable, such that said angle formed by said substantially planar inner surface of said first body portion and said substantially planar, inner surface of said second body portion is adjustable, said first body portion of said first elongated L-shaped piece comprises a male portion and said first body portion of said second elongated L-shaped piece comprises a female socket portion; and further wherein said first and second elongated L-shaped pieces are cooperatively structured to form a U-shaped body configured to adopt a mounted position over one of the sides or the top of the doorway opening formed through the wall in which:

said male portion and said female socket portion are coupled with one another, interlocking said first and second elongated L-shaped pieces to each other, said U-shaped body is dimensioned and configured to fit over and along one of the sides or the top of the doorway opening formed through the wall and extend over a portion of each of the oppositely disposed wall surfaces and the door-frame surface of the wall extending transversely therebetween, and said substantially planar inner surface of said first body portion of each of said first and second elongated L-shaped pieces abuts along and against the door-frame surface of the wall and said outer surface of said first body portion of each of said first and second elongated L-shaped pieces, faces outward of the door-frame surface of the wall towards a portion of the door, and said substantially planar inner surface of said second body portion of each of said first and second elongated L-shaped pieces faces a portion of a corresponding one of the oppositely disposed wall surfaces of the wall and said outer surface of said second body portion of each of said first and second elongated L-shaped pieces faces outward of the portion of the corresponding one of the oppositely disposed wall surfaces of the wall.

* * * * *